US006276887B1

(12) United States Patent
Hughes

(10) Patent No.: US 6,276,887 B1
(45) Date of Patent: Aug. 21, 2001

(54) METHOD OF FORMING BOARD BOOK SIGNATURES

(75) Inventor: Dennis Ray Hughes, Edinburg, TX (US)

(73) Assignee: R. R. Donnelly & Sons Company, Chicago, IL (US)

( * ) Notice: Subject to any disclaimer, the term of this patent is extended or adjusted under 35 U.S.C. 154(b) by 0 days.

(21) Appl. No.: 09/407,570

(22) Filed: Sep. 28, 1999

(51) Int. Cl.[7] ..... B42C 11/00; B42C 9/00

(52) U.S. Cl. ..... 412/1; 412/4; 412/8; 412/19; 412/37; 281/3.1; 281/21.1; 281/38

(58) Field of Search ..... 281/2, 3.1, 5, 12, 281/21.1, 38, 18; 412/1, 4, 8, 19, 37; 270/5.01, 32, 41, 45; 283/63.1

(56) References Cited

U.S. PATENT DOCUMENTS

| | | | | |
|---|---|---|---|---|
| 784,477 | | 3/1905 | Dean . | |
| 1,778,766 | | 10/1930 | McMichael . | |
| 2,544,568 | | 3/1951 | Shepherd . | |
| 3,866,900 | * | 2/1975 | Kebba | 270/5 |
| 4,828,636 | * | 5/1989 | Rausing | 412/8 |
| 4,932,679 | | 6/1990 | Mayer et al. | 281/18 |
| 5,076,611 | | 12/1991 | Bouton | 281/3.1 |
| 5,193,851 | | 3/1993 | Honegger | 281/15.1 |
| 5,655,866 | | 8/1997 | Bellanca | 412/1 |

* cited by examiner

*Primary Examiner*—Willmon Fridie, Jr.
(74) *Attorney, Agent, or Firm*—Fitch, Even, Tabin & Flannery

(57) ABSTRACT

A method and apparatus for the manufacture of board books including the folding of sheets into a four-page spread at a folding machine with each sheet having a pair of folds facing in one direction and a reverse integral fold facing in the opposite direction. At the folding machine, the second and third pages of the spread are adhered together to form an integral, four-page spread. These four-page spreads are placed into the feeding hoppers of a board book bindery line and adhesive is applied to one of the pages as the four-page spread is delivered to the conveyor. The integral four-page spreads, and any other spreads on the conveyor, are adhered to form a book block and a cover is added to complete the board book. The resulting board book has the pair of fold lines located at the book backbone and the integral reverse fold line is at the outer edge of the central page of the respective, four-page spreads in the board books.

12 Claims, 4 Drawing Sheets

METHOD OF FORMING BOARD BOOK SIGNATURES

FIELD OF THE INVENTION

This invention relates to children's board books and methods and apparatus for making such board books on binding lines.

BACKGROUND OF THE INVENTION

At present, children's board books as they are known, are printed and assembled by gluing two folded sheets of 18 pt. to 24 pt. chipboard together to make one spread. These spreads are than placed in hoppers and assembled on a binding line by gluing each spread to the next one as they are fed from the hopper. The size of the children's book is then only limited by the number of hoppers of a binding line, allowing one hopper for the cover. These lines normally contain sixteen hoppers which would create a thirty-page book plus the cover.

Should the book require more than sixteen hoppers, a two-stage production has been employed. In this process, two spreads are pre-gathered and glued together prior to being placed on the binding line; and this spread, which is now four pages instead of two, is placed in one hopper thereby allowing the book to attain as much as sixty pages plus a cover. This method, however, requires extensive hand work and becomes quite expensive. Also, adding more hoppers to the bindery becomes very expensive even assuming that the manufacturing facility has the floor space to do this.

SUMMARY OF THE INVENTION

This invention is directed to a board book having at least one spread with four pages integrally attached to one another with an outer reverse, integral fold between pages two and three of the spread. Herein, the preferred four-page spread is folded in a folding machine with a pair of folds that will be placed adjacent the backbone and an outer reverse fold between pages two and three.

Preferably, pages two and three are adhered to one another at the folding machine. It is therefore an object of this invention to provide a method of gluing the spread as part of the spread folding operation.

It is yet another object of this invention to increase the capacity of a binding line to more pages per book with the same number of hoppers using the four-page spread in the feeding hoppers.

It is yet another object of this invention to increase the capacity of the present binding line by using four-page spreads to produce two books on the same line that now only produces one book for the same manufacturing cycle.

In accordance with these and other objects of this invention, which will become apparent hereinafter, the instant invention will now be described with reference to the accompanying drawings.

DETAILED DESCRIPTION OF THE PREFERRED EMBODIMENT

Figure 1:
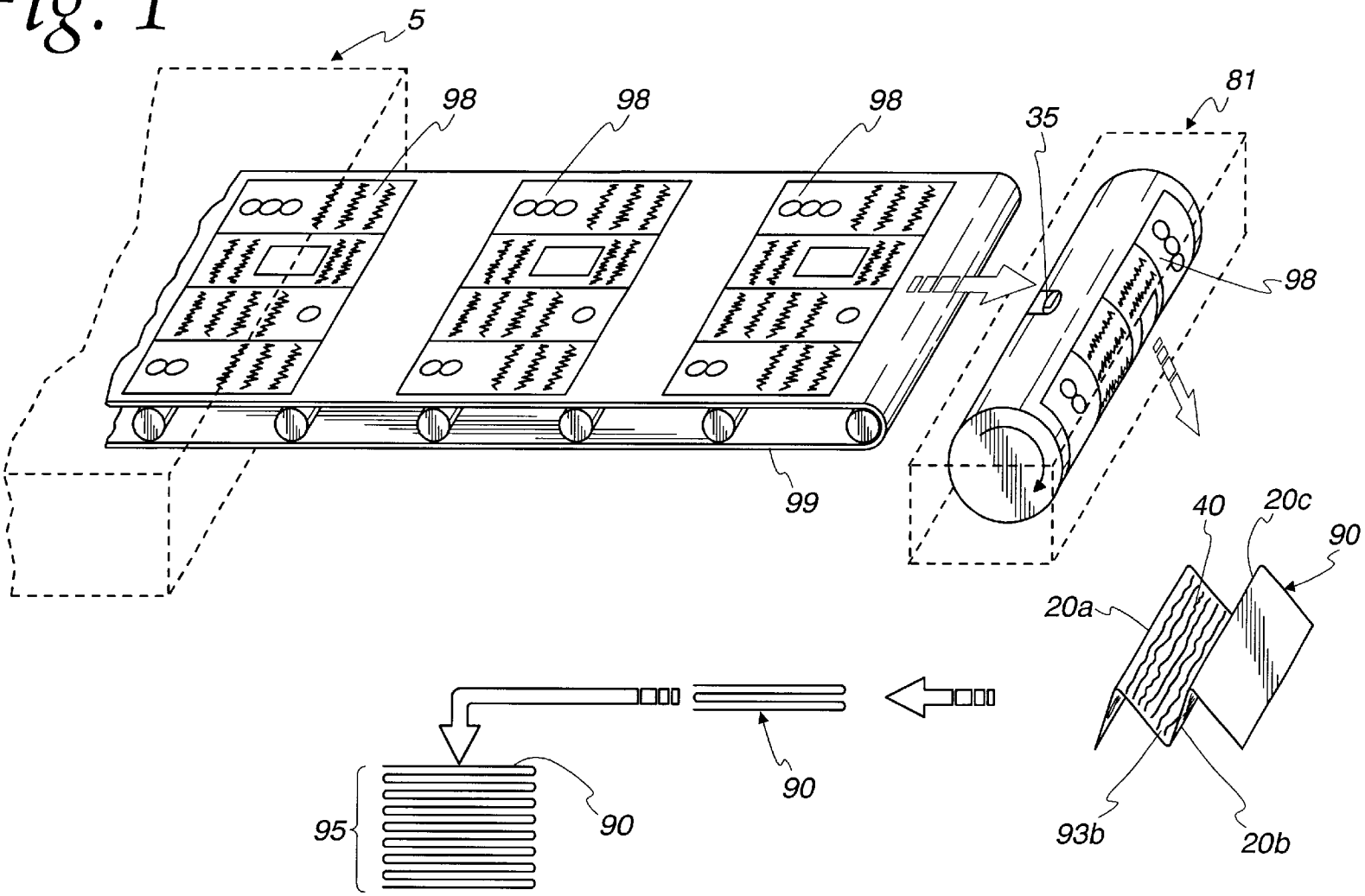
FIG. 1 shows a printing press delivering a four-page spread and folding, gluing and stacking same.

As shown in the drawings, for purposes of illustration, the invention is described with the use of FIGS. 1–12.

To aid in understanding the improvement disclosed by the present invention, it will be useful to explain the old method using a bindery line to form a board book, which is depicted in FIGS. 3–7.

Figure 3:
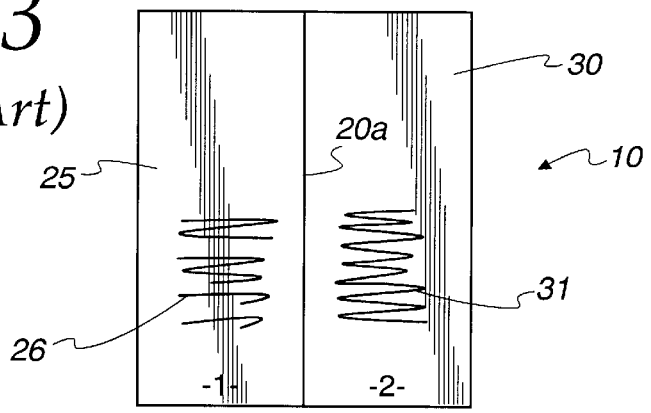
Fig. 3 (Prior Art)
FIG. 3 is a front view of a typical two-page spread.
Figure 4:
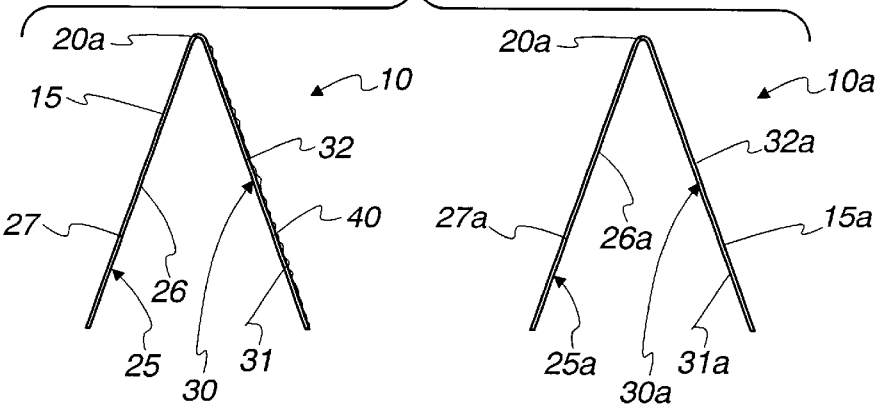
Fig. 4 (Prior Art)
FIG. 4 is a top view of two, two-page spreads which are prepared to be glued together.
Figure 5:
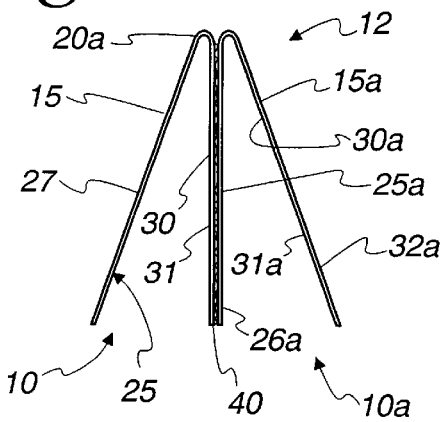
Fig. 5 (Prior Art)
FIG. 5 shows the spreads of FIG. 4 glued together.
Figure 6:
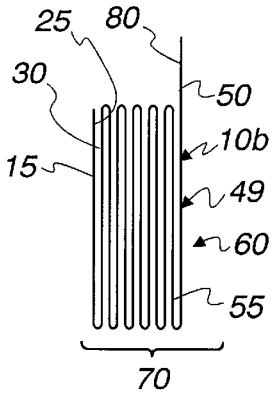
Fig. 6 (Prior Art)
FIG. 6 is a book block made up of two-page spreads and a cover.

As best seen in FIG. 3, a first two-page spread 10 has been printed with a first printed side 26 of a first spread 25, and a second printed side 31 of a first spread 30. The two-page spread also contains a first fold line 20*a* in order to fold the two printed sides 26, 31 of the first spread 25 and 30 against each other, as shown in FIG. 4. As the two-page spread is fed from a feed hopper of a bindery line, glue 40 is placed on a side 32 behind the second printed side 31 of the first spread 30 in order to join the first two-page spread 10 to a side 27*a* opposite a printed side 26*a* of a second two-page spread 10*a* (FIGS. 4 and 5). The second two-page spread 10*a* is fed from a second downstream hopper and is joined on the bindery line conveyor to the first two-page spread 10. The resulting assembly now forms a four-page book block 12 (FIG. 5) including the unprinted side 27 of a first spread 15; the first printed side 26 of the first spread 25; the second printed side 31 of the first spread 30; a first printed side 26*a* of a second spread 25*a*; a second printed side 31*a* of a second spread 30*a*; and an unprinted side 32*a* of second spread 15*a*.

Figure 7:
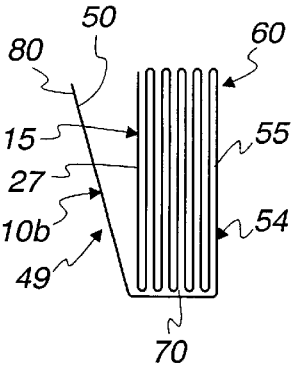
Fig. 7 (Prior Art)
FIG. 7 is the book block of FIG. 6 with the cover brought around to form a finished product.

Two-page spreads, such as 10 and 10*a*, are joined together in a bindery line 107 (FIG. 2) until an assembled book block of two-page spreads 60 is completed. The book block of two-page spreads 60 includes a front cover 49 of a two-page spread 10*b*, FIG. 6 with an unprinted side 50 of front cover 49, and a printed side 80 of front cover 49. The cover of the two-page spread 10*b* is then wrapped around a backbone 70 of assembled, two-page spread book blocks exposing a printed side 55 of back cover 54 and the printed side of front cover 49 (FIG. 7). The unprinted side 50 of front cover 49 is joined to the unprinted side 27 of the first spread 15 in order to form the completed, assembled, book block 60 of two-page spreads 10, 10*a*, etc. in FIG. 7.

As can be seen by the foregoing description, the size of the completed, assembled, book block 60 of two-page spreads 10, 10*a*, etc. will be limited to the quantity of two-page spreads, which can be assembled on a bindery line with a limited number of hoppers.

Figure 2:
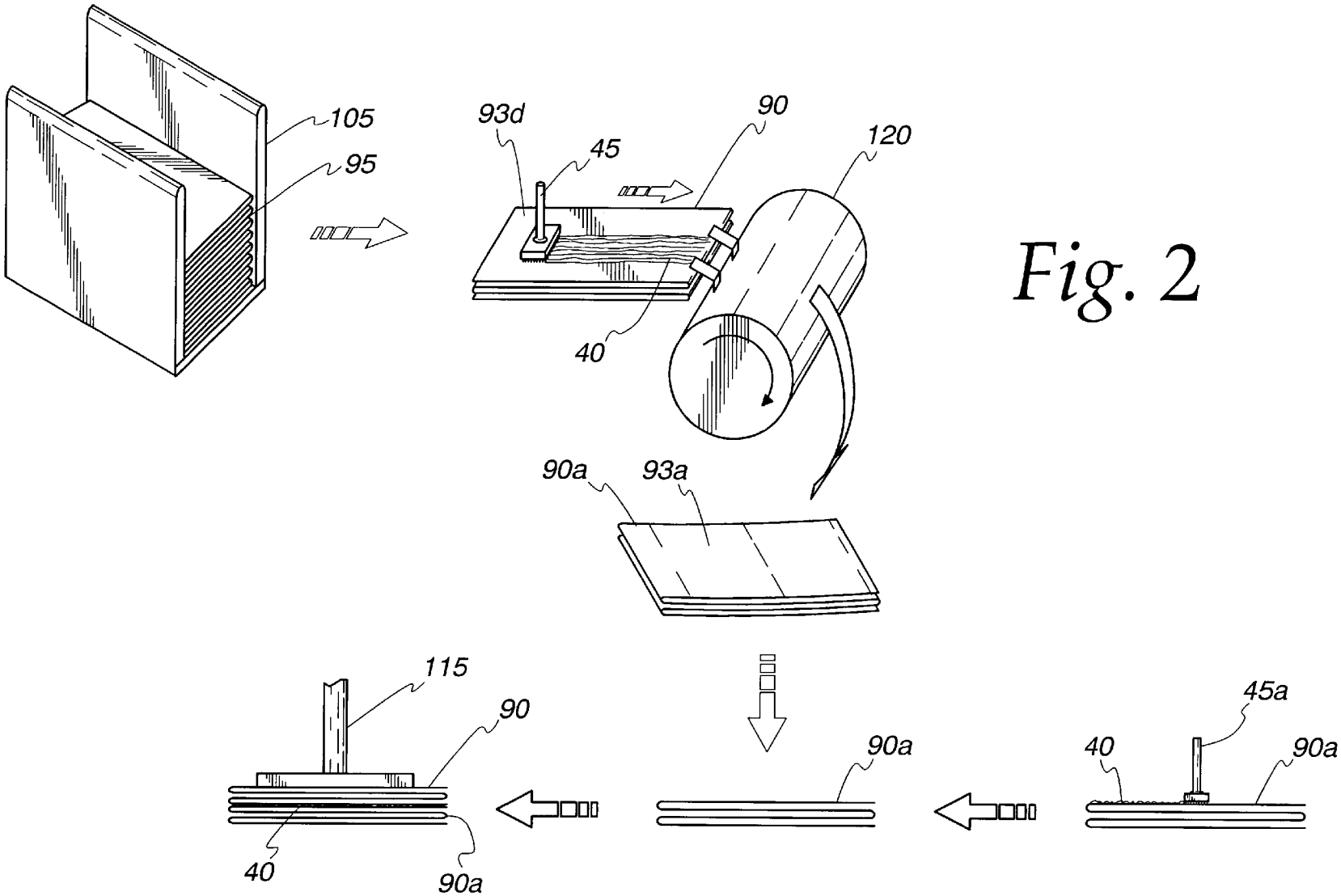
FIG. 2 shows the four-page spread of FIG. 1 being assembled into a book block on a binding line.
Figure 8:
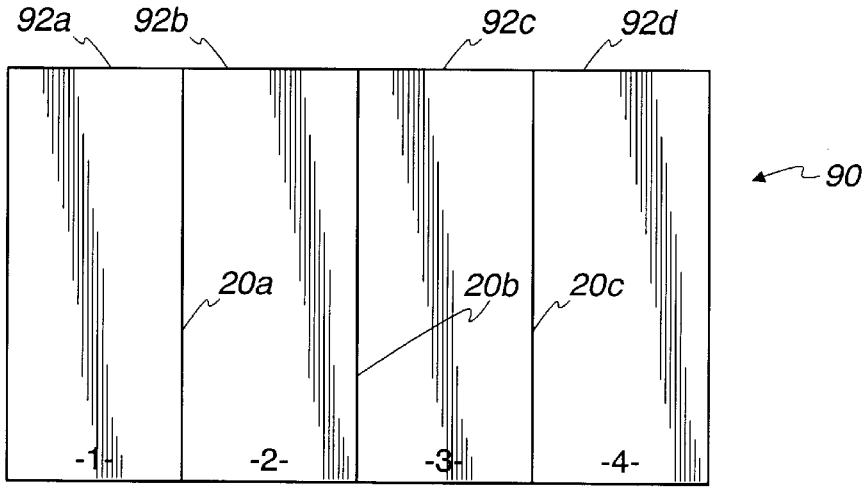
FIG. 8 is a front view of a proposed four-page spread.
Figure 9:
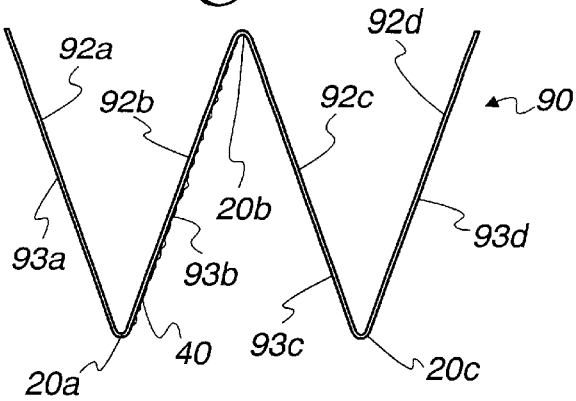
FIG. 9 is the top view of the four-page spread about to be glued.
Figure 10:
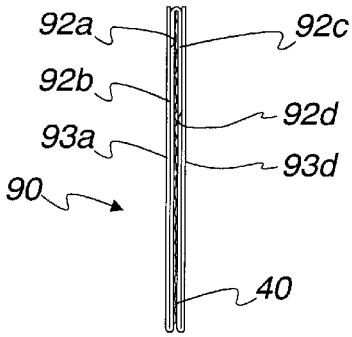
FIG. 10 shows the four-page spread after being glued together.
Figure 11:
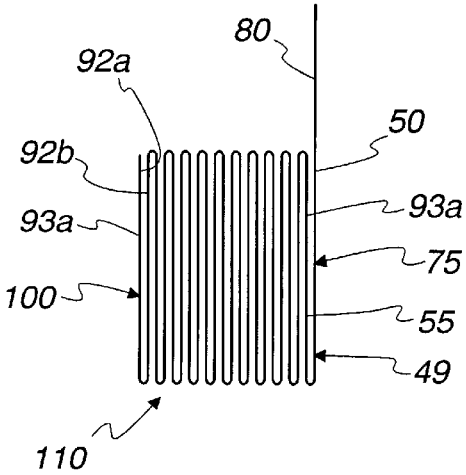
FIG. 11 is a book block made up of four-page spreads and a cover.

In accordance with the invention, integral four-page spreads 90, 90*a*, etc. are shown in detail in FIGS. 8 and 11, for feeding from bindery line hoppers 105 of a bindery line 107 (FIG. 2). This new concept of folding and gluing to form an integral, four-page spread 90 results in doubling the production capacity from the previously-described two-page spreads 10, 10*a*, etc. The first four-page spread 90 of FIG. 8 includes a first printed side of a four-page spread 92*a*, a second printed side of a four-page spread 92*b*, a third printed side of a four-page spread 92*c*, and a fourth printed side of a four-page spread 92*d*. The four-page spread also includes the first fold line 20*a*; a second reversely-directed, fold line 20*b*; and a third fold line 20*c*; and finally, a first unprinted side 93*a* of a four-page spread, a second unprinted side 93*b* of a four-page spread, a third unprinted side 93*c* of a four-page spread, and a fourth unprinted side 93*d* of a four-page spread (FIG. 9). The fold lines 20*a*, 20*b* and 20*c* are integral with and join the integral four pages of spreads together.

In accordance with the preferred embodiment of the invention and, as illustrated in FIG. 1, a series of printed blanks 98, each to be formed into a folded, integral, four-page spread 90, are delivered by a conveyor 99 from a printing machine at a printing station 5 to a folding machine 81, which folds the reverse integral fold 20*b* in a first folding operation and then folds the folds 20*a* and 20*c* in a second folding operation. Herein, the folding machine is that sold by Dick Moll & Sons of Warminster, Pa., to which a glue applicator 35 has been added. The glue applicator 35 at the folding machine applies glue 40 to a side 93*b* of a second page of the four-page spread. The second unprinted side 93*b* of the four-page spread is then joined to the third unprinted side 93*c* of the four-page spread resulting in the folded first four-page spread 90 of FIGS. 1 and 10. This folded, integral, first four-page spread 90 is added to a stack 95 of four-page spreads 90, as shown in FIG. 1, and the stack is delivered to and placed in a bindery line hopper 105 (FIG. 2), for delivery to a bindery line 107 (FIG. 2). In this example, the first four-page spread 90 is delivered from the bindery line hopper 105 to a gathering cylinder 120 at which time glue 40 may be applied to the fourth unprinted side of the four-page spread by a second glue applicator 45; or glue 40 may be applied to a second four-page spread 90*a* by an alternate second glue applicator 45*a* (FIG. 2). The first four-page spread 90 is placed over the second four-page spread 90*a* and consequently, glued together by virtue of the glue 40, which has been previously applied. This process continues with additional four-page spreads until a finished, assembled, book block 100 of four-page spreads 90, 90*a*, etc. is achieved. It might be found necessary to apply pressure at one or more phases of the assembly, and this can be accomplished by the use of a glue pressure tool 115 (FIG. 2).

Figure 12:
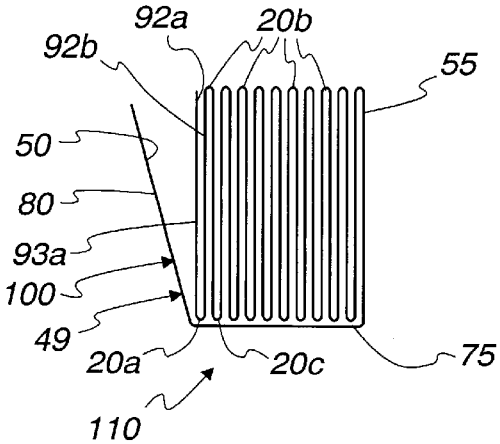
FIG. 12 is the book block of FIG. 11 with the cover brought around to form a finished product.

The assembled block 90 of four-page spreads now appears as in FIG. 11. The remaining process being the same as in the assembly of blocks of two-page spreads. Namely, the wrapping of a front cover 49 comprising an integral, four-page spread 75 which is around a backbone 110 of assembled, four-page spreads so that the unprinted side 50 of the front cover 49 is attached to the first unprinted side 93*a* of the four-page spread, and the printed side 80 of the front cover 49 is positioned outwardly, and the printed side 55 of the back cover 54 is left exposed (FIG. 12). If desired, the two-page spread cover shown in FIGS. 6 and 7 could be used rather than the four-page cover to cover the book block having he integral, four-page spreads therein.

Thus, it will be seen that the new, four-page preads have integral, reversely-folded lines 20*b* facing outwardly at the book block and joining pages two and three of the four-page spread. The other fold lines 20*a* and 20*c* are at the backbone 110. In the prior art, twopage spreads of FIG. 4, the fold lines 20*a* are located at the backbone 70; and there is no reverse, integral fold at the outer free edges of the joined, two-page spreads. As shown in FIG. 8, the folds 20*a* and 20*c* open upwardly; whereas, the reverse fold 20*b* opens downwardly.

The preferred method is quite economical from a production standpoint in that an automatic folding machine makes the folds 20*a*, 20*b* and 20*c*, and also applies the glue 40 to adhere sides 93*b* and 93*c* of the second and third pages of the four-page spread together. A stack 95 of these integral, four-page spreads, 90, 90*a*, etc. as well as a cover, are placed in the bindery line hoppers 105 which feed automatically the respective four page spreads to a continuously traveling, collating or collecting conveyor of the bindery line. Glue is applied at the bindery line to join adjacent, integral, four-page spreads together to form the book block. A cover is also fed from a bindery hopper over the assembled block of four-page spreads and wrapped automatically about the book block to form the completed board book. The board book may also have two-page spreads fed from a hopper of the bindery line to be adhered to adjacent four-page spreads, if so desired. That is, the board book may be a combination of two-page spreads and integral, four-page spreads.

Thus, it will be seen that the use of a new, integral, four-page spread made integrally from one piece of printed stock, and which can be made on a folding and gluing machine and delivered to the hoppers of the bindery line can double the production of the bindery line in the making of board books.

Although the invention has been described above with reference to specific embodiments thereof, it is apparent that many changes, modifications and variations can be made without departing from the concept disclosed herein. Accordingly, it is intended to embrace all such changes, modifications and variations that fall within the scope of the appended claims.

What is claimed is:

1. A board book formed on a signature-gathering machine comprising an outer cover on the book having a front cover page and a back cover page;

a plurality of spreads mounted within the cover and bearing indicia thereon;

some of the spreads being folded to have four pages integrally joined to each other to define an integral, four-page spread and having spread pages one, two, three and four, the spread pages have inner ends and outer ends;

each of the four page spreads having a pair of inner, integral fold lines joining inner ends of page one with page two and page three and page four with inner, integral folds being located at an inner backbone of the board book;

an integral, outer reverse fold line joining pages two and three being located at the outer edges of these pages and opposite the book backbone; and outer unfolded edges of pages one and four of adjacent four page spreads being adhered together to define an outer unfolded page edge without a fold line between pages one and four so that the outer book page edges having alternating folded and unfolded outer book page edges opposite the book backbone.

2. A board book in accordance with claim 1 wherein a plurality of integral, four-page spreads of 18 pt to 24 pt chip board are glued together to form a backbone of the children's board book.

3. A board book in accordance with claim 1 wherein one of the spreads has only two pages, and one of its pages is joined to one of the integral, four-page spreads.

4. A board book in accordance with claim 1 wherein the integral, four-page spreads have upper and lower, identical, printed portions thereon with a space therebetween at which the spread will be severed to form two identical board books.

5. A method of manufacture of board books comprising:

folding a plurality of separate sheets of board material to form a plurality of separate integral, four page spreads each having pages one, two, three and four integrally joined together with a reverse fold at the center joining pages two and three;

adhering together sheets two and three of the respective four page spreads, leaving four printed pages exposed to form an integral, four-page spread;

placing a plurality of the respective integral, four-page spreads having pages two and three adhered together into separated hoppers in a gathering machine and feeding the four page spreads from the hoppers to a gathering conveyor; and assembling the integral, four-page spreads fed from the separated hoppers on the gathering conveyor by adhering pages one and four of one spread to pages four and one respectively of adjacent preceding and succeeding four page spreads to form a book block and joining a cover to the book block thereby forming a covered board book.

6. A method in accordance with claim 5 including:

feeding of a cover from a hopper;

applying adhesive to one side of the cover; and adhering the adhesive bearing side of the cover to an adjacent integral, four-page spread.

7. A method in accordance with claim 5 including:

the feeding of a two-page spread from a hopper on the bindery line to the gathering conveyor; and adhering the two-page spread to one of the integral, four-page spreads on the bindery line.

8. A method of manufacture of board books comprising:

folding a sheet of board material to form four pages with a reverse fold at the center joining pages two and three;

adhering together sheets two and three, leaving four printed pages exposed to form an integral, four-page spread;

placing a plurality of integral, four-page spreads into hoppers in a gathering machine;

assembling the integral, four-page spreads together on a gathering conveyor to form a book block and joining a cover to the book block thereby forming a covered board book;

providing a binder line; and simultaneously feeding the same integral, four-page spreads from two hoppers on the bindery line and forming two identical board books simultaneously on the same bindery line.

9. A method of forming board books comprising:

folding a sheet into a four-page spread at a folding machine with a pair of folds facing in one direction, and a reverse, integral fold in the opposite direction, and adhering the second and third pages of the spread together in the folding machine to form an integral, four-page spread;

placing different, integral, four-page spreads into each of a plurality of hoppers in a bindery line;

feeding the respective, integral, four-page spreads from the hoppers and applying adhesive to one of the pages, as the four-page spreads are delivered to a conveyor;

adhering adjacent, integral four-page spreads together to form a book block while on the conveyor; and applying a cover to the board block to form the board book.

10. A method in accordance with claim 9 including feeding the integral, four-page spreads with the pair of fold lines therein being located upwardly to form the book back, and with the reverse fold being between pages two and three being located downwardly.

11. A method in accordance with claim 10 including:

feeding book covers from a hopper to the conveyor; and applying adhesive to one side of the book cover to adhere said book cover side to the book block containing four-page spreads.

12. A method in accordance with claim 9 including:

feeding a two-page spread from a hopper; and applying adhesive to a page thereof to join the two-page spread to an adjacent, integral, four-page spread on the conveyor.

* * * * *

UNITED STATES PATENT AND TRADEMARK OFFICE

CERTIFICATE OF CORRECTION

PATENT NO. : 6,276,887 B1
DATED : August 21, 2001
INVENTOR(S) : Dennis Ray Hughes It is certified that error appears in the above-identified patent and that said Letters Patent is hereby corrected as shown below:

Title page,
Item [73] Assignee, change "Donnelly" to -- Donnelley --

Signed and Sealed this

Fifth Day of March, 2002

*Attest:*

*Attesting Officer*

JAMES E. ROGAN
*Director of the United States Patent and Trademark Office*